United States Patent [19]

McCall et al.

[11] 3,974,634

[45] Aug. 17, 1976

[54] RESILIENT MOUNTING MEANS FOR A TRAVELER CLEANER

[75] Inventors: William S. McCall, Pendleton; Lester W. Pray, Clemson, both of S.C.

[73] Assignee: Platt Saco Lowell Corporation, Easley, S.C.

[22] Filed: Sept. 12, 1975

[21] Appl. No.: 612,938

[52] U.S. Cl. ..... 57/57

[51] Int. Cl.[2] ..... D01H 11/00

[58] Field of Search ..... 57/56, 57, 119, 121, 57/34 R, 34 T

[56] References Cited

UNITED STATES PATENTS

| | | | |
|---|---|---|---|
| 412,575 | 10/1889 | Whitin | 57/57 |
| 412,576 | 10/1889 | Whitin | 57/57 |
| 2,849,853 | 9/1958 | Francis | 57/57 |
| 3,095,685 | 7/1963 | Rogers | 57/57 |
| 3,400,529 | 9/1968 | Chilpan | 57/57 |

*Primary Examiner*—Donald E. Watkins
*Attorney, Agent, or Firm*—Donald H. Feldman

[57] ABSTRACT

Resilient mounting means for a traveler cleaner fixed to a textile ring holder includes a resilient member, formed from a vibration damping material such as rubber, fixed into or integral with a textile ring holder formed either of such material itself, or of metal, or of a combination sandwich type construction in the region in which the cleaner is to be fixed to the ring, and having embedded within and bonded thereto a threaded sleeve or stud to receive the cleaner. This mounting means permits the traveler cleaner to be resiliently restored to its aligned position relative a spinning or twisting ring and its traveler following accidental impact.

12 Claims, 4 Drawing Figures

RESILIENT MOUNTING MEANS FOR A TRAVELER CLEANER

BACKGROUND OF THE INVENTION

1. Field of the Invention

Figure 1:
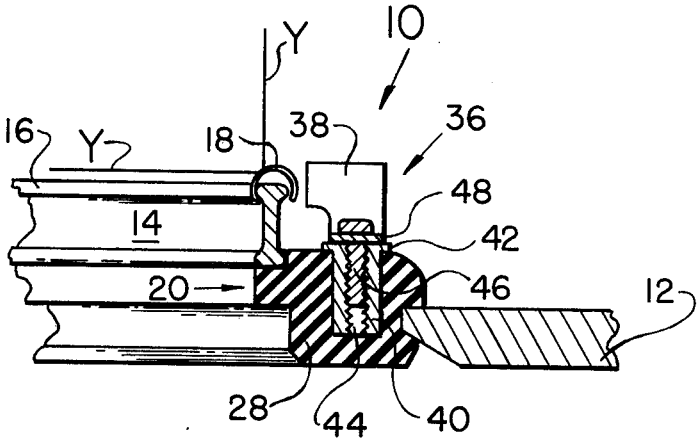

The present invention relates to a resilient mount for a cleaner blade, as a part of a spinning or twister ring holder of a textile yarn spinning or twister machine. The mount is provided to receive a traveler cleaner and hold it in alignment relative the rotational course of travel of a spinning or twisting ring traveler about a spinning or twisting ring during the spinning or twisting of yarn so as to remove from said traveler any foreign accumulations or accretions.

2. The Prior Art

It is generally well known in the art to provide a spinning or twisting ring assembly with a traveler cleaner for the purpose of removing lint and other foreign matter from the traveler during the process of spinning or twisting yarn. The cleaner has a blade portion which is positioned in a precisely spaced away relation to the course of rotational travel of the ring traveler about the spinning or twister ring, so as to effect removal of said foreign matter accumulated. Failure to remove the build up of foreign matter, in time, results in the production of poor quality yarn and/or its breaking. The alignment requirements are to have the confronting edge of the blade spaced away from the course of rotation of the traveler sufficiently so that the blade does not intercept such course and stop the traveler, but not so far away from said course that the blade does not intercept foreign matter accreted upon the traveler. If the blade does intercept the course of traveler rotation, yarn breakage occurs; however, if the blade does not intercept the foreign matter, the traveler is not cleaned. The aforesaid alignment prescribes that the cleaner be rigidly mounted, and also that such mounting be made adjustable so that the cleaner may be moved towards or away from the upper flange of the spinning or twister ring to accommodate for changes in the size of traveler as may occur when one wishes to change the size of yarn to be processed. A typical ring, ring holder and traveler cleaner assemblage is shown in U.S. Pat. No. 3,400,529.

Most ring holders are of metal, to provide structural rigidity, and cleaners are mounted thereon using a screw as shown in aforesaid U.S. Pat. No. 3,400,529. However, in recent times, with the recognition that harmful noise generated by the moving contact of the traveler against the upper flange of the ring may be reduced by making the ring holder or a transverse portion thereof of a vibration damping material, disclosures of such ring holders have been made, for example in British Pat. No. 871,889 and in U.S. Pat. Nos. 2,454,707 and 3,093,957. However, disclosure of a suitable mounting for a traveler cleaner was singularly absent from such constructions.

In actual mill operations, several problems have been encountered respecting the mounting of traveler cleaners on ring holders. Among these, the more common problem of the cleaner being inadvertently struck is perhaps the most significant. This may occur when a bobbin is doffed or donned off or onto a spindle. If the force with which the cleaner blade is struck is great enough, the blade may be bent toward or away from the traveler course. Thus, the bent blade then may either intersect the traveler course to stop the rotation of the traveler and break the yarn, or may be moved away from the traveler course enough so as not to intercept accretions of foreign matter on the traveler, causing, in time, the production of poor quality yarn and yarn breakage. If, on the other hand, the cleaner is not rigidly fixed to the holder, the striking force may move the blade out of its proper alignment relative the traveler course without bending it, but still produce the undesirable results of stopping the traveler or failure to clean it. Either way, yarn breakage results, and the yarn processing station is out of production until a bent cleaner can be replaced and/or the cleaner be realigned properly. Unfortunately, the problems of a bent cleaner blade or is dislodgement from proper alignment are not immediately recognized by mill operators, and then only after some interval during which the yarn is broken and/or poor quality yarn is produced that remedial action is taken. Beyond this, with respect to metal ring holders, repeated shocks by the blade being struck a number of times tend to inflict wear upon the screw thread of the holder making it, in time, impossible to rigidly secure the cleaner thereonto.

It is to the assuage of the aforesaid problem and difficulties that the present invention is directed.

With respect to rings being formed entirely or in part of a vibration damping material, such as rubber, to the advent of the present invention no satisfactory means of securing a cleaner to such material was known, despite repeated attempts, including the use of self-threading screws. When the latter were used, it was found that either the screw could not be held by the material in a rigid manner, or that in time the screw when subjected to the usual vibration of the yarn processing machine would work itself loose and with it the cleaner. Further, because of the nature of vibration damping material, such as its resilient properties, it was most difficult to properly align a cleaner properly, since in the process of mounting the cleaner on the material the frictional characteristics of the material caused the cleaner to turn when the last tightening to firmly secure the cleaner was made. Thus, to this writing, no prior art ring holders formed at least in part of a vibration damping material have been successfully used in commercial production of yarn.

The present invention is further directed to use with ring holders formed at least in part of a vibration damping material, to remedy the want of such a holder in commercial production of yarn.

SUMMARY OF THE INVENTION

The present invention comprises, in combination with a ring holder and a traveler cleaner, mounting means for the rigid, yet resilient mounting of the traveler cleaner upon the ring holder. The mounting means comprises a resilient member integral with or bonded to the body of the ring holder in a region of the holder suitable for the proper fixing and alignment thereat of a traveler cleaner, and a female threaded sleeve of a rigid and durable material, such as a structural metal or plastic, set into and bonded to said resilient member for joining the cleaner thereto with a screw.

The present invention has several advantages. For example, if a traveler cleaner blade is mounted by the present means and is struck as aforesaid, the blade will endure the force without becoming bent or deformed and resiliently be returned to its proper position of alignment relative the course of traveler rotation for cleaning the traveler. Further, one may rigidly secure the cleaner through the present mounting means into a position of proper alignment very quickly and easily without encountering problems of misalignment upon final tightening which beset prior art attempts. Also, one may use the present mounting means with an otherwise all metal holder, or one having a body portion of vibration damping material with equal efficacy and benefit. Regarding the latter, by employing the present mounting means, one for the first time may use a ring holder formed entirely or in part of a vibration damping material for the commercial production of yarn in a successful manner to gain the benefits of reducing otherwise injurious noise levels.

Yet further desirable objects and advantages of the invention will become apparent from or are inherent in the descriptions which follow and the appended claims.

DRAWINGS

Figure 2:
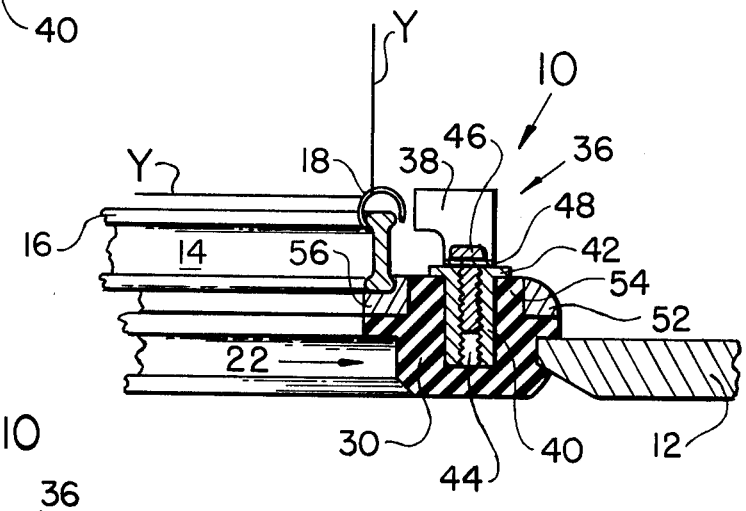
Figure 3:
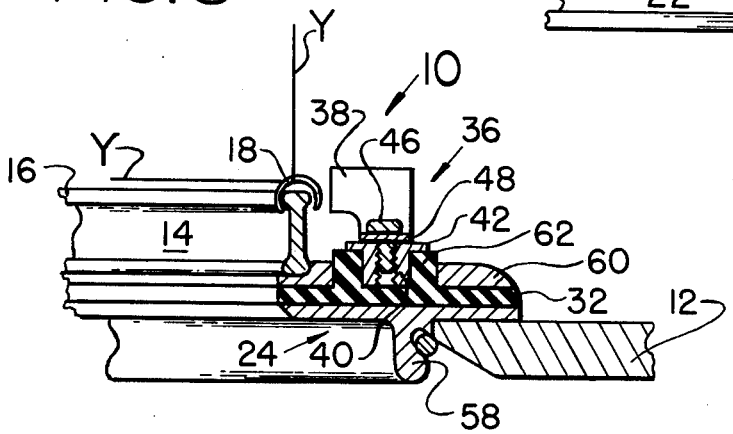
Figure 4:
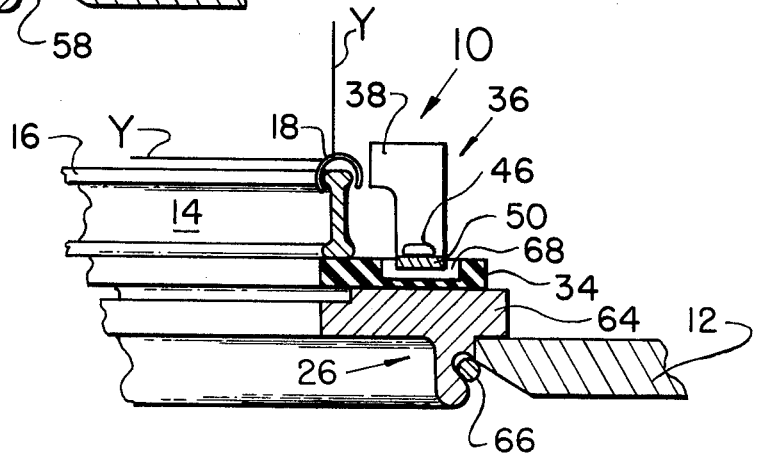

A fuller understanding of the nature of the present invention and its usage may be had through the descriptions and explanations below when taken in conjunction with the appended drawings in which:

FIG. 1 shows, in fragmentary radial section taken through the mounting means of the invention, a ring holder of resilient, vibration damping material fixed to a ring rail, holding a spinning ring and traveler thereon, and bearing a traveler cleaner fixed thereto by said mounting means;

FIG. 2, otherwise similar to the construction of FIG. 1, shows in radial fragmentary section a mounting means of the invention fixed to a laminated spinning ring holder with an upper metal body portion and a lower body portion of a resilient, vibration damping material;

FIG. 3, in similar fashion to FIGS. 1 and 2, shows in radial fragmentary section a mounting means of the invention being integral with an intermediate body portion of a ring holder, said intermediate portion being formed of a resilient, vibration damping material being sandwiched between and bonded to an upper and a lower metal body portion of the ring holder; and FIG. 4, in radial fragmentary section taken through a depending flange of a traveler cleaner, shows a portion of the present mounting means being integral with an upper body portion of the ring holder said portion being formed with a radially directed alignment slot.

EMBODIMENTS

An otherwise conventional spinning ring and ring holder assemblage, generally designated 10, is shown in FIGS. 1 through 4 to be held within an orifice of a ring rail 12 of a textile yarn spinning frame (otherwise not shown). It comprises a metal spinning ring 14 bearing at its top flange 16 a traveler 18 which is threated with a yarn Y for winding rotation thereabout and onto a textile spindle bobbin (not shown), and a ring holder 20,22,24,26 having a body portion 28,30,32,34 formed of a resilient, vibration damping material, which holder 20,22,24,26 firmly holds ring 14 to ring rail 12. In each figure, a traveler cleaner 36 is mounted to be in spaced away adjacency to the course of movement of traveler 18 around flange 16 of ring 14, such that its blade portion 38 may intercept any foreign accretions or accumulations which traveler 18 may acquire during the processing of yarn Y.

With reference to FIG. 1, ring holder 20 is formed entirely of a resilient, vibration damping material, such as any of the rubber compounds known to be useful in this regard and having sufficient structural strength and integrity for its present supportive use. In the region of holder 20 for mounting of traveler cleaner 36 such that its blade portion 38 may be properly aligned to intercept foreign matter on traveler 18, according to the invention a substantially rigid, inflexible and durable sleeve 40 having a top flange 42 is bonded within a recess 44 in the body portion of the resilient material of ring holder 20. Sleeve 40 is formed with a thread to receive a screw 46 for adjustable alignment and rigid fixing of cleaner 36 relative holder 20 and of its blade 38 relative the course of movement of traveler 18 about ring 14. Cleaner 36 is of conventional design, having in addition to its upstanding blade 38 a horizontal portion 48 with a slot therethrough (not shown) to receive screw 46. Also, as shown in FIG. 4, cleaner 36 may have a downwardly depending flange 50, as further described below.

The present mounting means for cleaner 36 also may be used with and form a part of a ring holder 22 which is a composite of a metal annulus 52 and an annulus 30 of a resilient, vibration damping material as aforementioned. In FIG. 2, annulus 30 has an upstanding portion 54 at least in the region of holder 22 suitable for mounting of cleaner 36 in proper alignment with the course of traveler 18. Portion 54 is sufficiently wide to accept therewithin bonded, threaded sleeve 40 and at its top surface to surround flange 42 in abutment therewith. Portion 54 may be limited to the aforesaid region of holder 22 and pass through metal annulus 52 in said region, or portion 54 may divide metal annulus 52 into an inner annulus 56 and an outer annulus, said metal annuli for certain applications being useful to secure ring 14 at the inner portion of annulus 56 and for reinforcement of ring holder 22.

In FIG. 3, ring holder 24 also is of composite structure, wherein body portion 32 of a resilient, vibration damping material is sandwiched between and bonded to a lower metal body portion 58 and an upper metal body portion 60. In similar fashion to the embodiment shown in FIG. 2, in the area of holder 24 suitable for mounting traveler cleaner 36, intermediate resilient body portion 32 has an upstanding portion 62 passing through upper body portion 60 of sufficient size as to receive therewithin rigid threaded sleeve 40, its top flange 42 being in abutting contact and surrounded by the top surface of portion 62.

With certain types of traveler cleaners 36, beyond an upstanding blade 38 and a horizontal portion 48 integral therewith, the latter having as mentioned a slot therethrough to admit screw 46, they may have a depending flange integral with horizontal portion 48, such as flange 50 shown in FIG. 4. The purpose of flange 50 is to act as an aligning guide so that the confronting edge of cleaner blade 38 is set at the proper angle relative the course of movement of traveler 18 about ring 14 in order to intercept foreign accretions on traveler 18 and sweep it clean as the traveler passes said edge.

This is seen in FIG. 4, wherein the ring holder 26 again is of composite structure having a lower metal annulus 64 for mounting holder 26 onto ring rail 12 secured thereto by means of an O snap ring 66 and to provide structural support to the composite, and having an upper body portion 34 formed of a resilient, vibration damping material as aforesaid, portion 34 being bonded to annulus 64 at their interface to form a unitary structure. Ring 14 is fixed to holder 26 by bonding it at its lower flange surface to the upper surface of resilient body portion 34. This embodiment may have mounting means of the invention provided inwardly of the section shown of a similar construction to those shown in FIGS. 1 through 3, including a rigid, threaded structural sleeve received within and bonded to body portion 34 for receiving screw 46 and fixing cleaner 36 to holder 26. Means for adjusting the proper distance of the confronting edge of cleaner blade 38 relative the course of movement of traveler 18 about flange 16 is provided in the usual manner by having the slot through the horizontal portion (not shown) of cleaner 36 of elongate shape the limits of which determine the extent to which inward or outward placement of cleaner 36 may be made. As said, downwardly depending flange 50 of cleaner 36 is used to provide for angular alignment of blade 38. In this regard, body portion 34 of holder 26 is provided with a slot 68 of rectangular section long enough to accommodate the extent of inward or outward placement of cleaner 36 and wide enough to receive flange 50. Slot 68 may be formed in body portion 34 such that the former is set at the proper angle to align blade 38, and for the most common cleaners 36, slot 68 is disposed radially in holder 26.

ALTERNATIVE CONSTRUCTIONS

While in the foregoing embodiments it was shown and described that holders bearing mounting means of the invention have body portions or in their entirety are formed of a resilient, vibration damping material, the holder may indeed be of an all metal construction; however, with such a construction, a recess is provided in the region suitable for the mounting of a traveler cleaner to receive therewithin and bonded thereto an outer sleeve of a resilient material which may have vibration damping properties. This outer resilient sleeve in turn has bonded thereto an inner threaded sleeve to receive the screw which fixes the traveler cleaner to the holder.

While it has also been shown and described that the inner threaded sleeve surrounded by a resilient material is of a structural metal, such as steel, such a sleeve may be of another material with the requisite properties of rigidity, strength, durability and bondability to the resilient material, such as a structural plastic like certain types of nylon, or urethane among others.

Further, while it has been shown and described that the present mounting means requires a rigid sleeve, which is threaded to receive the fixing screw for securing the cleaner thereto, rather than a threaded sleeve one may employ a threaded stud embedded into and bonded to the presently required resilient material, the screw thread of which may protrude above the upper surface of the holder to receive the cleaner and a nut to secure the latter thereto.

From the foregoing descriptions and explanations, it will be readily appreciated that many variations in contour of elements, their materials of construction and means for joining the elements together will immediately become apparent to one skilled in the art beyond what is explicitly disclosed above to effect the concept of this invention as defined in the appended claims.

That which is claimed is:

1. In combination with a textile yarn spinning or twisting ring holder and a traveler cleaner, mounting means fixed to said ring holder comprising a resilient member fixed to said ring holder in the region thereof appropriate for the mounting of said cleaner upon said holder, and a rigid member fixed to and within said resilient member, being formed with means by which said cleaner may be joined to said holder.

2. Mounting means as in claim 1, wherein said resilient member is integral with said holder.

3. Mounting means as in claim 1, wherein said resilient member is bonded to said holder.

4. Mounting means as in claim 1, wherein said rigid member is bonded to said resilient member.

5. Mounting means as in claim 1, wherein said means for joining said cleaner to said holder comprises a screw thread.

6. Mounting means as in claim 1, wherein said rigid member comprises a sleeve bearing a female screw thread therewithin.

7. Mounting means as in claim 1, wherein said rigid member comprises a stud bearing a male screw thread thereon.

8. Mounting means as in claim 1, wherein said resilient member is formed of rubber.

9. Mounting means as in claim 1, wherein said resilient member is formed of a vibration damping material.

10. Mounting means as in claim 1, wherein said rigid member is formed of metal.

11. Mounting means as in claim 1, wherein said rigid member is formed of plastic.

12. In combination with a textile yarn spinning or twisting ring holder and a traveler cleaner, mounting means for the rigid, yet resilient mounting of said cleaner upon said holder comprising a resilient member integral with said holder, and a rigid member fixed within said resilient member and being formed with means by which said cleaner may be joined to said holder.

* * * * *